US006224242B1

(12) United States Patent
Giraud et al.

(10) Patent No.: US 6,224,242 B1
(45) Date of Patent: May 1, 2001

(54) LUMINAIRE

(75) Inventors: Christian Giraud, Dagneux; Niels Van Duinen, Lyons; Gert-Jan B. De Vries, Meyzieu, all of (FR)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/320,622

(22) Filed: May 26, 1999

(30) Foreign Application Priority Data

May 29, 1998 (EP) ..... 98401305

(51) Int. Cl.[7] ..... F21V 29/00

(52) U.S. Cl. ..... 362/287; 362/285; 362/368; 362/371; 362/419

(58) Field of Search ..... 362/285, 287, 362/427, 418, 419, 429, 368, 370, 371, 372, 432

(56) References Cited

U.S. PATENT DOCUMENTS 3,213,270 10/1965 Appleton et al. .
3,543,016 * 11/1970 Jones ..... 362/421
4,410,933 * 10/1983 Blake et al. ..... 362/371
5,353,211 10/1994 Merko ..... 362/294

* cited by examiner

*Primary Examiner*—Stephen Husar
*Assistant Examiner*—John Anthony Ward
(74) *Attorney, Agent, or Firm*—F. Brice Faller

(57) ABSTRACT

The luminaire has a housing (1), a mounting bracket (3) and a coupling (4) to connect the housing adjustably with the bracket (3). The coupling (4) has a first part (10) secured to the housing (1), a second part (20) fixed to the bracket (3) and a blocking device (5), the first and the second parts (10, 20) being nested and coupled. The blocking device (5) may have a blocking member (12, 14) coupled to one of the parts (10, 20) and a seat (21, 22) therefor in the other of the parts (10, 20). The coupling (4) allows for rotating the housing (1) from its adjusted position and to bring it back into its original position without the need to adjust it again.

19 Claims, 3 Drawing Sheets

LUMINAIRE

BACKGROUND OF THE INVENTION

The invention relates to a luminaire comprising:

a housing with means for accommodating an electric lamp therein;

a mounting bracket for fastening to a support;

a coupling which connects the housing adjustably to the mounting bracket.

Such a luminaire is known from U.S. Pat. No. 5,353,211. In the known luminaire, the coupling consists of a threaded bolt which is screwed into a threaded hole in the housing. Before the threaded bolt is completely tightened, the bolt forms a horizontal shaft about which the housing can be pivoted upwards or downwards so as to illuminate the desired field by means of the luminaire. Once the correct position of the housing has been found, the latter is fixed in that the bolt is tightened.

Luminaires are often used in locations where they are accessible with difficulty, often from one side only, for example from the rear. This is the case, for example, when a luminaire is used for lighting, for example, a sports ground and is mounted against a framework at the top of a mast or at the edge of a roof, for example the edge of the roof of a spectator stand. It may be necessary in that case to loose the coupling and rotate the housing in the case of maintenance of the luminaire, for example for cleaning a reflector in the luminaire or a transparent plate which closes off the housing, or for replacing a lamp.

In a luminaire of the known kind, the housing must be accurately realigned when the maintenance work has been completed so as to achieve the original adjustment again. This is time-consuming and requires craftsmanship. The necessity of a repeated alignment is accordingly a major disadvantage of the known luminaire.

The adjustment of the housing with respect to the mounting bracket, with the object of throwing the light beam formed by the luminaire in the desired direction, should not be confused with the positioning of an electric lamp in the housing of the luminaire so as to give this lamp the correct position relative to a reflector in the housing and to create a light beam of the desired shape, i.e. with the desired light distribution. The essence of the luminaire described in the cited U.S. Pat No. 5,353,211 indeed lies in this adjustment of the shape of the light beam.

SUMMARY OF THE INVENTION

It is an object of the invention to provide a luminaire which is of a simple construction and which renders it possible to replicate a previously determined position of the housing with reference to the mounting bracket after a rotation of the housing.

According to the invention, the coupling comprises a first part which is fixedly connected to the housing and a second part located in or around and coupled to the first part and fastened to the mounting bracket, the first and the second part being rotatable relative to one another, and the coupling having a blocking device with an operational position from which it can be released, and with release positions, which blocking device in its operational position locks the first and the second part in a previously defined mutual rotational position.

The luminaire is brought into position and fixed while the blocking device of the coupling is in its operational position.

During alignment of the luminaire, the connection between the coupling and the mounting bracket is loosed, so that the second part is in an adjustment condition, and the housing is steplessly rotatable about the mounting bracket. To this end, for example, a sight may be fastened to the housing, or the lamp in the luminaire may be lit. As soon as the correct adjustment has been found, the housing is fixed in this position in that the loosed connection between the second part of the coupling and the mounting bracket is fixed.

When maintenance work is to be carried out on the luminaire now, for which purpose the housing is to be rotated together with the first part of the coupling relative to the mounting bracket in order to be accessible to the service engineer, the blocking device is loosed, so that the first part of the coupling becomes rotatable relative to the second part, and the blocking device is removed from its operational position as far as is desired. After the maintenance work has been completed, the housing is rotated back and the blocking device is brought into its operational position again so as to lock the first and the second part of the coupling against mutual rotation. The housing can thus be returned to its original operational orientation in a comparatively simple manner.

It is practical when the blocking device comprises a resilient blocking element and a seat which cooperates therewith in the operational position. A force is then required for removing the resilient blocking element from its seat. In an embodiment of the luminaire, this may be a force which is exerted for the purpose of rotating the first and the second part of the coupling relative to one another. To prevent inadvertent rotations, the force necessary for rotation is greater than a chosen minimum force, while less force is necessary for a subsequent further rotation. Upon turning back into the operational position, the resistance to rotation will increase appreciably after the operational position has been reached, and the fact that the operational position has been reached may also be audible by means of a click.

The resilient blocking element may be, for example, a shaped blade spring, for example with a V-shaped portion which may grip into a recess, for example V-shaped, as the seat. It is alternatively possible for this blocking element to comprise a ball which is under spring pressure. The housing will then quasi-automatically enter the same position as before, without a visual inspection being necessary.

In an alternative embodiment, the blocking member has a blocking element in the form of a pin under spring pressure, for example a pointed pin, which can enter a bore, for example a cylindrical bore, as the seat. The cylindrical bore may have a tapering entrance so as to be easily accessible. When the blocking element has been pulled from its seat against the spring pressure, the parts of the coupling can be mutually rotated. When the parts are rotated back, the blocking element will enter its seat again under spring pressure when the original position of these parts has been reached. This embodiment has the advantage that an inadvertent rotation, for example under the influence of strong wind, is prevented.

It is alternatively practical when the blocking element is a rigid body, for example a screw, which is introduced into a seat through rotation, for example a screw with a conical tip in a conical seat. This embodiment has the advantage of a high storm resistance and also of a high reliability, because material fatigue of a spring cannot play any role. A screw having a conical tip in a matching seat has the additional advantage of a very high positioning accuracy and a small play.

When this blocking device is to be returned from a release position into the operational position, said rigid blocking element may be given a slight compression force, so that a friction will obtain during the rotation of the parts of the coupling relative to one another, which friction will disappear the moment the blocking element has arrived opposite its seat. A conical entrance to this seat is favorable in this respect.

In a special embodiment, the luminaire has a first blocking device with a resilient blocking element which moves from the release position into the operational position under spring pressure, and a second blocking element which comprises a rigid blocking element. This embodiment has the advantage that after a rotation of the housing, which is then to be returned to its original position, said original position can be readily found back from the fact that the resilient blocking element springs into its seat, which is noticeable from an increased or very high resistance to rotation, depending on the design of this element and of the seat, and the luminaire is locked in this position through the action of a rigid blocking element which is independent of spring pressure, such as a screw.

The mounting bracket may be, for example, L-shaped. It is favorable, however, for a stable mounting of the housing when the housing is supported at two sides. For this purpose, the bracket may be given, for example, a U-shape. The housing may be fastened to one or to both legs of the bracket by means of the coupling described. The replication of the adjusted relative position of the housing and the bracket is ensured already with the use of one such "coupling with memory for the adjusted position" after a rotation for maintenance purposes. The second coupling may be a conventional one.

The luminaire may be constructed such that the connection between the housing and the first part of the coupling is loosed during positioning of the housing relative to the mounting bracket, when the luminaire is being aligned. Said first part may be fastened to the housing, for example with bolts which can slide in slots having the shape of a circular arc. It is easy, however, if the second part of the coupling is rotatable relative to the bracket after the connection has been loosed. The connection may be provided by a bolt and a threaded hole which cooperates therewith, for example in a nut.

The second part of the coupling may surround the first part, but a convenient construction is one in which the first part surrounds the second part. The first and the second part of the coupling may be manufactured from a synthetic resin or from a metal such as, for example, aluminum. It is favorable in general when the innermost (first or second) part comprises the seat for a blocking device and the outermost (second or first) part the blocking element. A resilient blocking element which is released from its seat upon a rotation of the two parts, however, may alternatively be connected to the innermost (first or second) part.

The luminaire may be designed for accommodating one or several electric lamps, for example a halogen lamp or discharge lamp, which may or may not be tubular in shape, such as, for example, a high-pressure metal vapor discharge lamp. The lamp may be positioned in the direction of the light beam to be formed or transversely thereto.

DETAILED DESCRIPTION OF THE PROFFERED EMBODIMENTS

Figure 1:
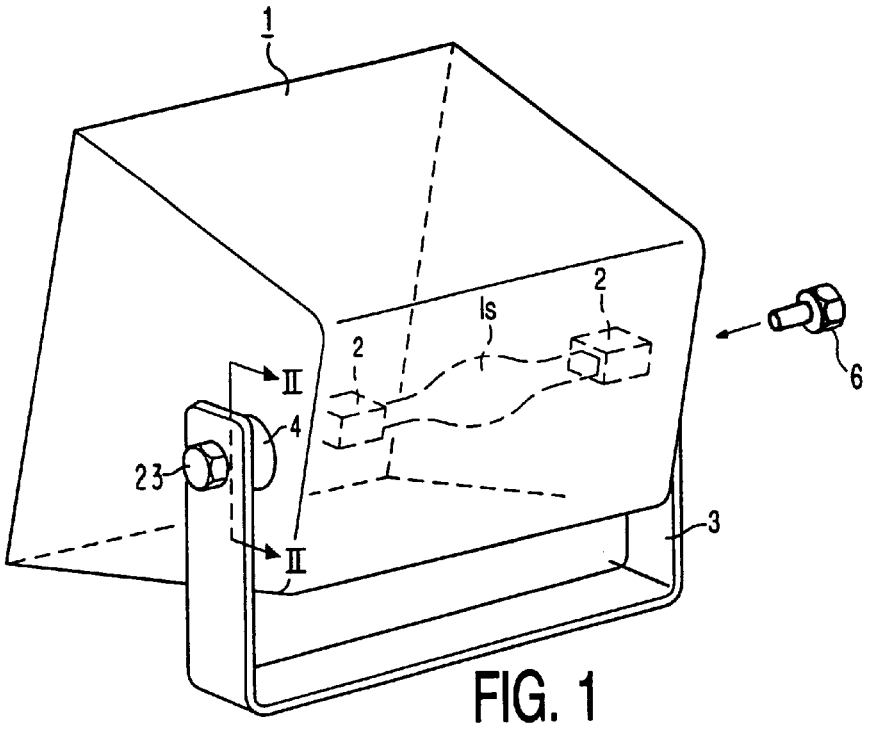
FIG. 1 shows the lumaire in perspective view.

In FIG. 1, the luminaire has a housing 1 with means 2 for accommodating therein an electric lamp Is and a mounting bracket 3 for fastening to a support. A coupling 4 connects the housing 1 adjustably to the mounting bracket 3. The mounting bracket 3 in the Figure is U-shaped, and the luminaire has a second coupling 6 in line with the coupling 4. The electric lamp is is a high-pressure metal halide discharge lamp which is held and electrically supplied at its two ends.

Figure 2:
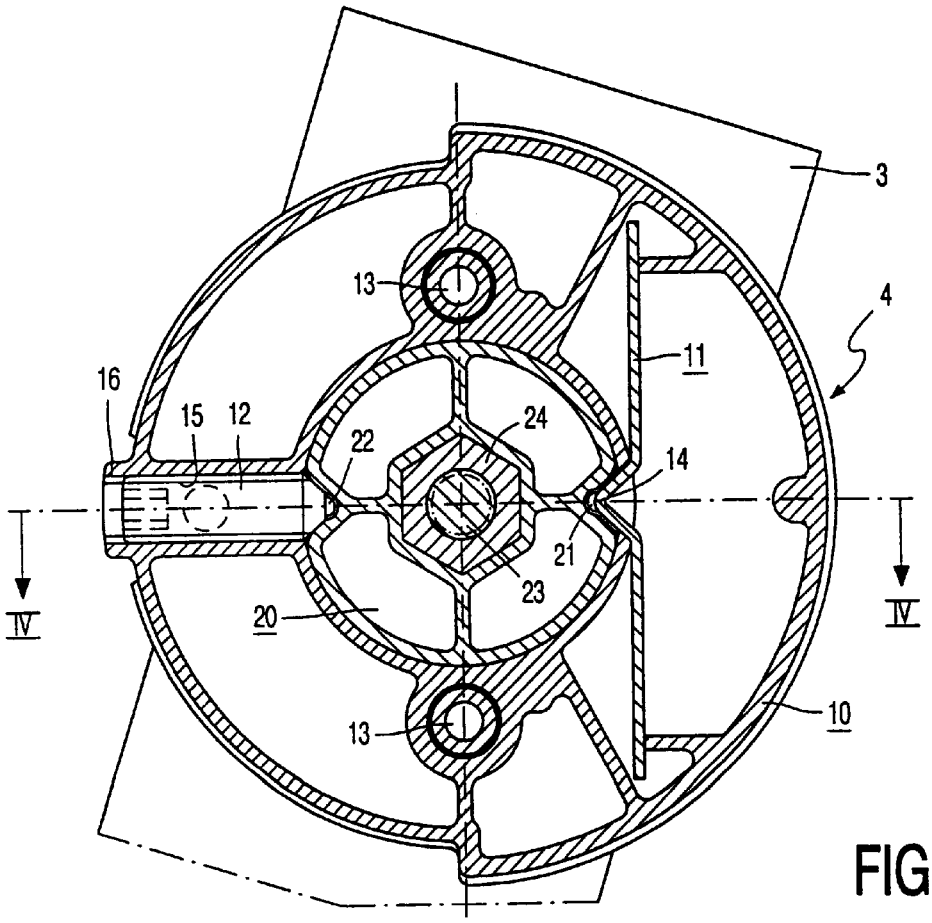
FIG. 2 shows the coupling taken on the line II—II in FIG. 1.
Figure 3:
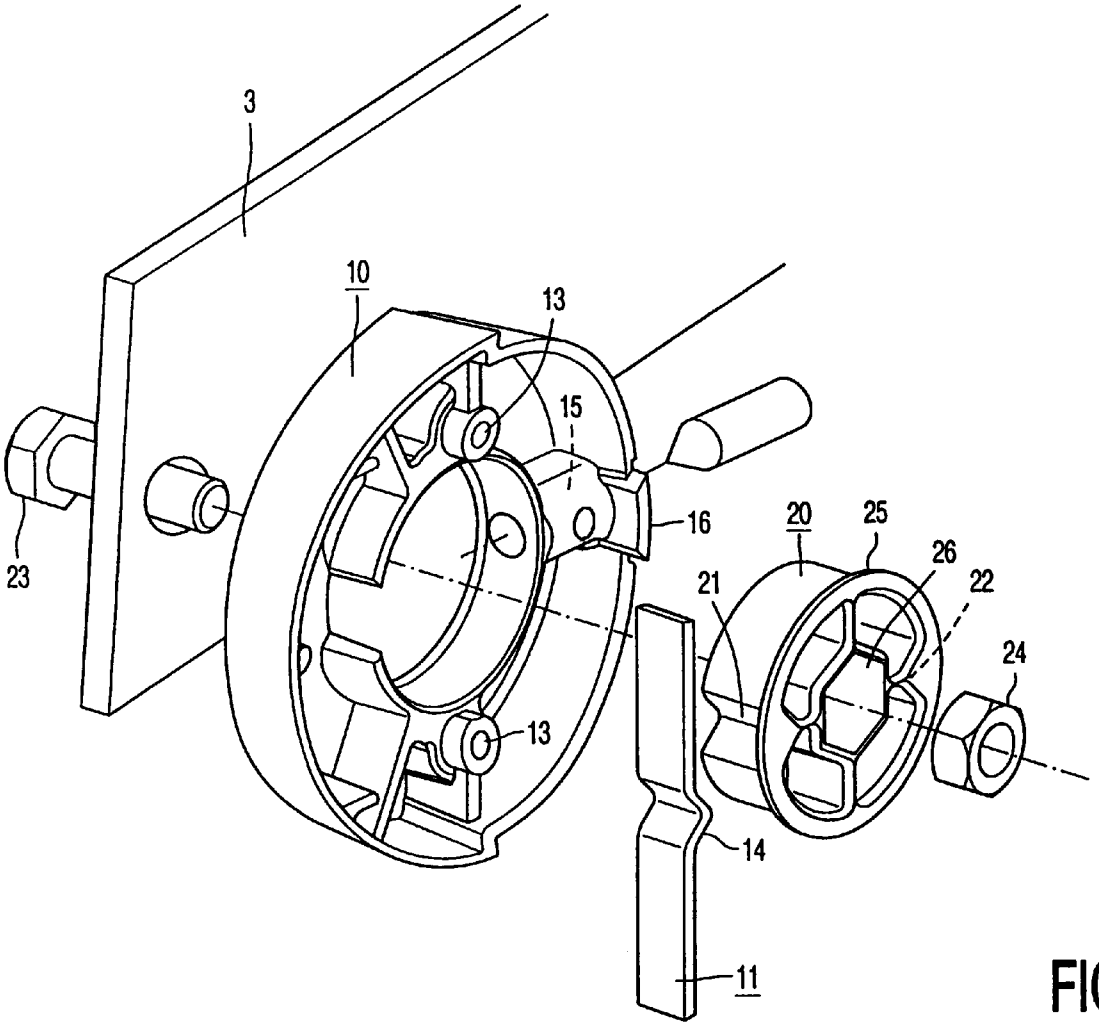
FIG. 3 is an exploded view of the coupling of FIG. 2.
Figure 4:
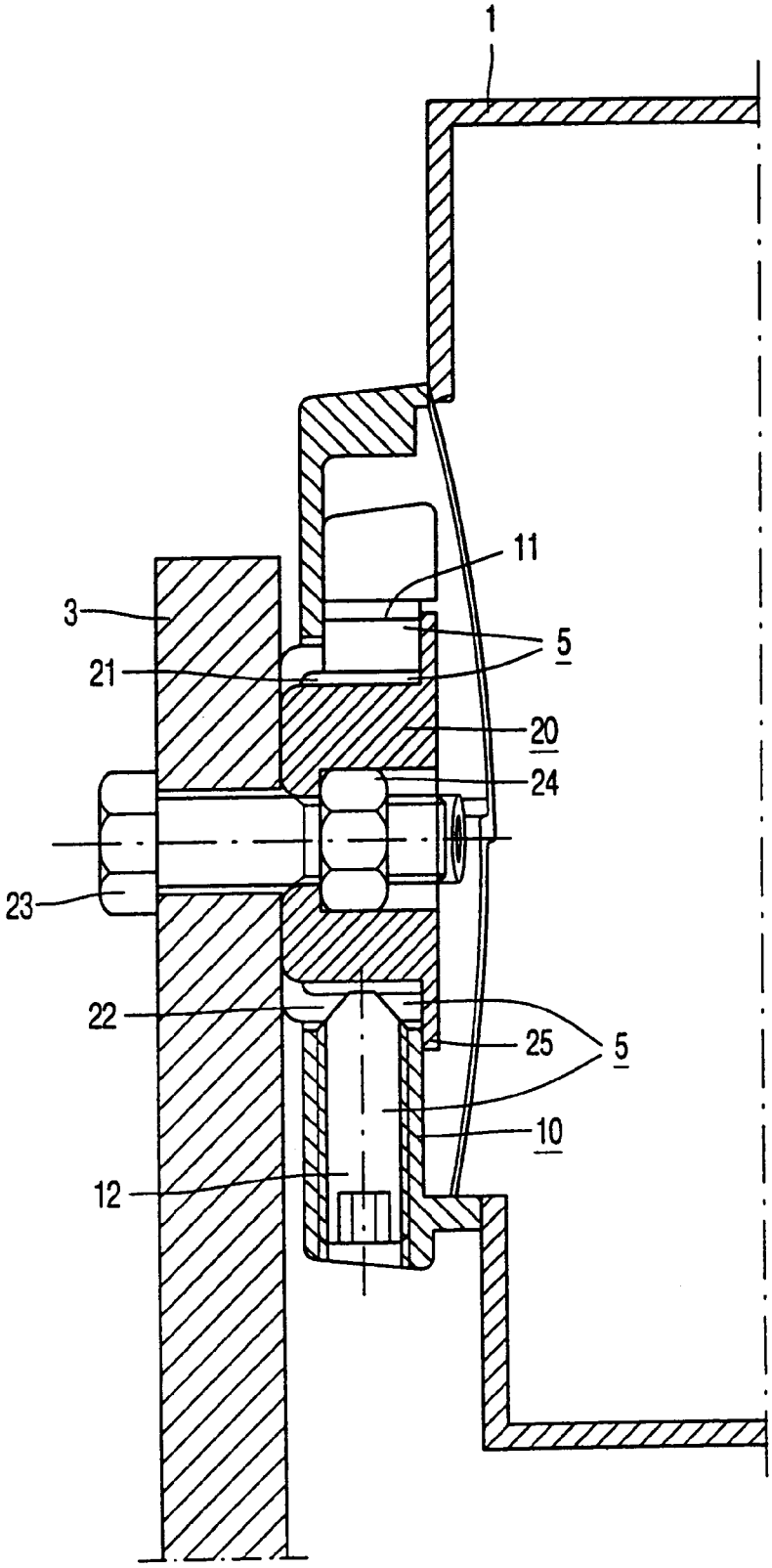
FIG. 4 is a cross-section taken on the line IV—IV in FIG. 2.

The coupling 4, see FIGS. 2, 3 and 4, comprises a first part 10 which is fixedly connected to the housing 1, and a second part 20 matching with and coupled to the first part and fastened to the mounting bracket 3. The first part 10 and the second part 20 are mutually rotatable here. The coupling 4 has a blocking device 5 with an operational position from which it can be released, and release positions. The blocking device 5 in its operational position locks the first part 10 with respect to the second part 20 in a previously defined rotational position. The second coupling 6 may be identical to or of a similar kind as the coupling 4. Alternatively, the coupling 6 may be a conventional coupling formed by a threaded bolt screwed into the housing 1 or a threaded stud projecting from the housing in combination with a nut.

The coupling 4 will be explained in more detail with reference to FIGS. 2, 3 and 4. The coupling 4 has a blocking device 5 with a first, resilient blocking element 11 and a first seat 21 cooperating therewith.

The resilient blocking element 11 can be removed from the seat 21 in that the first 10 and the second part 20 of the coupling 4 are rotated relative to one another.

The blocking device 5 also has a second, rigid blocking element 12 and a second seat 22 cooperating therewith, into which second seat the blocking element 12 can be screwed home.

The first part 10 of the coupling 4 surrounds the second part 20.

The second part 20 of the coupling 4 is connected to the mounting bracket 3 by means of one threaded bolt 23.

The blocking device 5 has its blocking elements 11, 12 connected to the first part 10 of the coupling 4 and the cooperating seats 21, 22 in the second part 20 of the coupling 4.

In FIGS. 3 and 4, a projecting rim 25, by means of which the second part 20 is axially coupled to the first part 10, is visible at the second part 20 of the coupling 4. The second part 20 has a central cavity 26 which is shaped so as to lock a nut 24 against rotation. When the bolt 23 is tightened in the nut 24, the first part 10 becomes closed in, and the second part 20 is tightened against the mounting bracket 3, see FIG. 4.

The first part 10 has holes 13, FIGS. 2 and 3, through which screws can fix this part against the housing 1 of the luminaire.

The resilient blocking element 11 is a blade spring with a fold 14 which can enter the seat 21.

The rigid blocking element 12 shown is a socket head screw with a conical tip. The threaded cavity 15 in the first part 10 in which this screw is present is partly closed off with a cover 16. The cover 16 renders it possible to unscrew the screw from its seat 22, but prevents the screw from being entirely unscrewed from the cavity 15 to the exterior.

In the embodiment shown, the seats 21 and 22 are present opposite one another, but they could also occupy alternative positions relative to one another. The seats are of equal shapes, as is evident from FIG. 2. The resilient blocking element 11 can provide a stable position of the housing by snapping into the seat 22 when the housing has been rotated through 180° during maintenance. Alternatively, however, the seat 22 may be conical, so that the element 11 as shown will not fit therein.

The threaded bolt 23 and the second, conventional coupling 6, see FIG. 1, are loosed, as is the rigid blocking element 12 of FIG. 2, when maintenance is to be performed on the luminaire. The housing 1 is then rotated by exerting a comparatively great force is exerted thereon. The resilient blocking element 11 then loses its grip in the seat 21, and the housing can be rotated further by means of a comparatively small force. After the maintenance work has been completed, the housing 1 is rotated back. A luminaire having exclusively conventional couplings, such as the second coupling 6, would have to have its housing aligned again in order to be returned accurately into its original position.

In the luminaire according to the invention, by contrast, the housing 1 is rotated back until the resilient blocking element 11 arrives opposite the seat 21 and snaps itself into it. This is audible in the embodiment shown. In addition, any effort to rotate the housing 1 further would require a considerably greater force on the housing in order to force the resilient blocking element 11 from its seat again compared with the force necessary for overcoming the friction with the second part 20 while the blocking element 11 was sliding over the second part 20 of the coupling 4. The housing 1 has found and occupied its original position again quasi-automatically.

A fine adjustment of this position and a high storm resistance are achieved by tightening the second, rigid blocking element 12 is tightened into the second seat 22. Finally, the second coupling 6 is tightened, if so desired.

The luminaire according to the invention has a memory for the position of the housing 1 once this has been adjusted: it can be easily and quickly returned to its original position without alignment of the housing 1 and without the use of visual means.

What is claimed is:

1. A luminaire comprising:

a housing (1) with means (2) for accommodating an electric lamp therein;

a mounting bracket (3) for fastening to a support;

a coupling (4) which connects the housing (1) adjustably to the mounting bracket (3), wherein the coupling (4) comprises a first part (10) fixedly connected to the housing (1) and a second part (20) coupled to the first part and fastened to the mounting bracket (3), the first part (10) and the second part (20) being rotatable relative to one another, and the coupling (4) having a blocking device (5) with an operational position from which it can be released, and with release positions, which blocking device (5) in its operational position locks the first part (10) and the second part (20) against relative rotation in either direction in a previously defined rotational position.

2. A luminaire as claimed in claim 1, characterized in that the blocking device (5) comprises a resilient blocking element (11) and a seat (21) cooperating therewith.

3. A luminaire as claimed in claim 1, characterized in that the resilient blocking element (11) can be removed from the seat thereby permitting the first part (10) and the second part (20) of the coupling (4) to be rotated relative to one another.

4. A luminaire as claimed in claim 1, characterized in that the blocking device (5) comprises a rigid blocking element (12) and a seat (22) cooperating therewith, into which seat the blocking element (12) can be rotated inwards.

5. A luminaire as claimed in claim 1 wherein the blocking device (5) comprises a first, resilient blocking element (11) and a first seat (21) cooperating therewith, and a second, rigid blocking element (12) and a second seat (22) cooperating therewith, into which second seat (22) the blocking element (12) can be rotated inwards.

6. A luminaire as claimed in claim 5, wherein the first, resilient blocking element (11) can be removed from the seat (21) wherein the first part (10) and the second part (20) of the coupling (4) are rotated relative to one another.

7. A luminaire as claimed in claim 1, characterized in that the first part (10) of the coupling (4) surrounds the second part (20).

8. A luminaire as claimed in claim 1 wherein the second part (20) of the coupling (4) is connected to the mounting bracket (3) by means of one threaded bolt (23).

9. A luminaire as claimed in claim 7, characterized in that the blocking device (5) comprises a blocking element (11, 12) connected to the first part (10) of the coupling (4) and a mating seat (21, 22) in the second part (20) of the coupling (4).

10. A luminaire comprising:

a housing (1) with means (2) for accommodating an electric lamp therein;

a mounting bracket (3) for fastening to a support;

a coupling (4) which connects the housing (1) to the mounting bracket (3) for lockable rotation about an axis, wherein the coupling (4) comprises a first part (10) fixedly connected to the housing (1) and a second part (20) coupled to the first part and fastened to the mounting bracket (3), in an adjustment condition the second part being rotatable with respect to the mounting bracket, and in a fixed condition the second part being fixed with respect to the mounting bracket, the first part (10) and the second part (20) being rotatable relative to one another, and the coupling (4) having a blocking device (5) with an operational position from which it can be released, and with at least one release position, which blocking device (5) in its operational position locks the first part (10) and the second part (20) against relative rotation in either direction, in a rotational position defined by fixing the second part to the mounting bracket.

11. A luminaire as claimed in claim 10, characterized in that in the fixed condition the second part (20) of the coupling (4) is fixed to the mounting bracket by means of one threaded bolt (23).

12. A luminaire as claimed in claim 10, characterized in that the blocking device (5) comprises a resilient blocking element (11) and a seat (21) cooperating therewith.

13. A luminaire as claimed in claim 10, characterized in that the resilient blocking element (11) can be removed from the seat (21) thereby permitting the first part (10) and the second part (20) of the coupling (4) to be rotated relative to one another.

14. A luminaire as claimed in claim 10, characterized in that the blocking device (5) comprises a rigid blocking element (12) and a seat (22) cooperating therewith, into which seat the blocking element (12) can be rotated inwards.

15. A luminaire as claimed in claim 10, wherein the blocking device (5) comprises a first, resilient blocking element (11) and a first seat (21) cooperating therewith, and a second, rigid blocking element (12) and a second seat (22) cooperating therewith, into which second seat (22) the blocking element (120 can be rotated inwards.

16. A luminaire as claimed in claim 15, wherein the first, resilient blocking element can be removed from the seat (21) and wherein the first part (10) and the second part (20) of the coupling (4) are rotatable relative to one another when the resilient blocking element is removed from the seat.

17. A luminaire as claimed in claim 10, characterized in that the first part (10) of the coupling (4) surrounds the second part (20), and the second part includes means (25) for retaining the first part while the second part is in the adjustment condition and in the fixed condition.

18. A luminaire as claimed in claim 17, characterized in that the second part (20) of the coupling (4) is connected to the mounting bracket (3) by means of one threaded bolt (23).

19. A luminaire as claimed in claim 18, characterized in that the blocking device (5) comprises a blocking element (11, 12) connected to the first part (10) of the coupling (4) and a mating seat (21, 22) in the second part (20) of the coupling (4).

* * * * *